United States Patent [19]

Sogami et al.

[11] Patent Number: 4,810,111

[45] Date of Patent: Mar. 7, 1989

[54] RESISTIVE RIBBON THERMAL TRANSFER PRINTING APPARATUS

[75] Inventors: Atsushi Sogami, Hirakata; Noboru Katakabe, Uji; Tetsuhiro Sano, Hirakata; Orio Yoshii, Yawata, all of Japan

[73] Assignee: Matsushita Electric Industrial Co., Ltd., Osaka, Japan

[21] Appl. No.: 149,518

[22] Filed: Jan. 28, 1988

[30] Foreign Application Priority Data

| | | | |
|---|---|---|---|
| Jan. 29, 1987 | [JP] | Japan | 62-19194 |
| Apr. 10, 1987 | [JP] | Japan | 62-89420 |
| Apr. 10, 1987 | [JP] | Japan | 62-89424 |

[51] Int. Cl.[4] ..... B41J 3/12; B41J 3/20

[52] U.S. Cl. ..... 400/120; 346/76 PH

[58] Field of Search ..... 400/119, 120, 121; 346/76 PH

[56] References Cited

U.S. PATENT DOCUMENTS

| | | | |
|---|---|---|---|
| 4,623,903 | 11/1986 | Hashimoto | 346/76 PH |
| 4,679,055 | 7/1987 | Inui | 346/76 PH |
| 4,688,051 | 8/1987 | Kawakami | 346/76 PH |
| 4,692,044 | 9/1987 | Aviram et al. | 400/120 |

FOREIGN PATENT DOCUMENTS

| | | | |
|---|---|---|---|
| 72482 | 4/1983 | Japan | 400/120 |
| 67477 | 4/1983 | Japan | 400/120 |
| 67068 | 4/1984 | Japan | 400/120 |
| 59-167279 | 9/1984 | Japan . | |
| 59-167280 | 9/1984 | Japan . | |
| 60-78766 | 5/1985 | Japan . | |
| 143975 | 7/1985 | Japan | 400/120 |
| 60-214157 | 10/1985 | Japan . | |
| 211060 | 9/1986 | Japan | 400/120 |
| 295056 | 12/1986 | Japan | 400/120 |

OTHER PUBLICATIONS

Resistive Ribbon Thermal Transfer Printing: A Historical Review and Introduction to a New Printing Technology, by Keith S. Pennington and Walter Crooks; IBM J. Res. Develop. vol. 29, No.5, Sep. 1985.

*Primary Examiner*—Paul T. Sewell
*Assistant Examiner*—Steven S. Kelley
*Attorney, Agent, or Firm*—Wenderoth, Lind & Ponack

[57] ABSTRACT

A resistive ribbon thermal transfer printing apparatus produces two kinds of electric pulses for selectively energizing recording electrodes of a printing head according to a data to be printed. A first electric pulse (normal pulse) is applied to a recording electrode which is to be energized and is disposed between two recording electrodes which are to be energized. A second electric pulse (specific pulse) is smaller in energy than the normal pulse and is applied to a recording electrode which is to be energized and is not disposed between two recording electrodes which are to be energized. This selective application of the two kinds of pulses allows the size of the printed dots to become uniform.

10 Claims, 11 Drawing Sheets

FIG. 17 (a) PRIOR ART
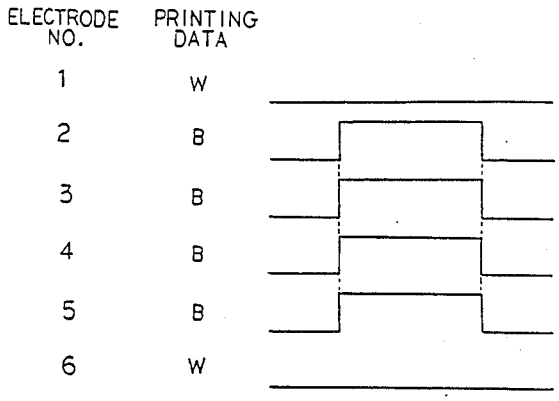
FIG. 17 (b) PRIOR ART
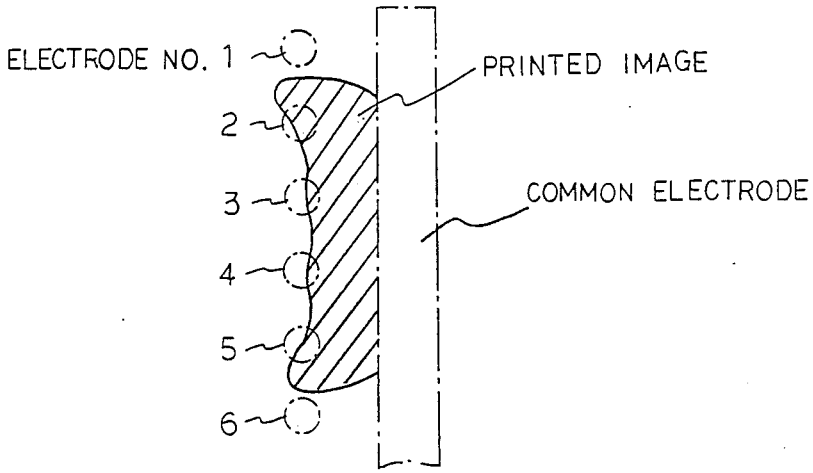

RESISTIVE RIBBON THERMAL TRANSFER PRINTING APPARATUS

BACKGROUND OF THE INVENTION

1. Field of the Invention

This invention relates to a resistive ribbon thermal transfer printing apparatus which uses a resistive ribbon comprising a resistive material layer and a thermally molten ink layer and a plurality of selectively energized electrodes for causing a current to pass through the resistive material layer to cause the ink layer to be selectively molten and transferred to a receiving material such as a paper.

2. Description of the Prior Art

As a thermal transfer printing technology, which is known as a low-cost and high-quality printing technology, resistive ribbon thermal transfer printing technology is known as shown in "Resistive ribbon thermal transfer printing: A historical review and introduction to a new printing technology" by K. S. Pennington, IBM J. RES. DEVELOP. VOL. 29 NO. 5 SEPTEMBER 1985.

The basic method for energizing the plurality of electrodes is to apply voltage pulses of a same pulse width to the electrodes for printing dots at the same time as shown in FIG. 17(*a*). In FIG. 17(*a*), the printing data "W" denotes "white" where the corresponding electrode is not energized, and the printing data "B" denotes "block" where the corresponding electrode is energized to print a dot. In this method, however, the flow of the current passed through the part of the resistive material layer under an energized electrode between two adjacent energized electrodes is different from the flow of the current passed through the part under an energized electrode adjacent to an unenergized electrode. The currents caused to flow by two adjacent energized electrodes interfere with each other to be reduced by each other. But the current caused to flow by an energized electrode adjacent to an unenergized electrode passes through a larger area than the area through which the current caused to flow by an energized electrode between two adjacent energized electrode. This causes the printed dots to be not-uniform as shown in FIG. 17(*b*), which shows a printed image by the pulses shown in FIG. 17(*a*). In FIG. 17(*b*), the dots formed by the electrode Nos. 2 and 5 are larger than those formed by the electrode Nos. 3 and 4.

To solve the above problem, a time-divisional energizing method was introduced as shown, for example, in Japanese Laid-Open patent application No. 59-167279. In this method, a plurality of electrodes are divided into blocks and the electrodes in each block are energized time-divisionally by time-divisional pulses as shown in FIG. 18. This method can solve the above problem of not uniform printed image, but has some new problems. One problem is that the printing speed becomes low due to the time-divisional driving. Another problem is that the linearity of the printed image becomes worse because the different electrodes are energized at different timings. Still another problem is that the resistive ribbon would be damaged due to a shock of a large pulse current flown through a small area in a short period.

SUMMARY OF THE INVENTION

An object of the present invention is to provide a resistive ribbon thermal transfer printing apparatus which is capable of printing an image of uniform dot size and of good linearity at high speed.

To achieve this object, the resistive ribbon thermal transfer printing apparatus according to the present invention uses a resistive ribbon comprising a resistive material layer and an ink layer being in contact with a surface of a receiving member on which an image is to be printed, and comprises:

a printing head having a plurality of recording electrodes and a common electrode disposed in a spaced relationship to the recording electrodes, the recording and common electrodes being made in contact with the resistive material layer of the resistive ribbon;

a driving unit for moving at least one of the resistive ribbon and the printing head relatively to each other;

an energizing circuit for selectively energizing the plurality of recording electrodes at substantially the same time by electric pulses; and a control unit for controlling the energizing circuit according a data to be printed, the control unit causing the energizing circuit to apply a normal electric pulse having a predetermined energy to a recording electrode which is to be energized and disposed between two recording electrodes which are to be energized, and causing the energizing circuit to apply a specific electric pulse which is smaller in energy than the normal electric pulses to a recording electrode which is to be energized but is not disposed between two recording electrodes which are to be energized.

In an preferred embodiment, each normal electric pulse is a single voltage pulse of a predetermined pulse width, and the specific electric pulse is a single voltage pulse having a smaller pulse width than that of the normal voltage pulse and occurring during the duration of the normal voltage pulse.

In another preferred embodiment, each normal voltage pulse is divided into at least two sequentially occurring sub-pulses, and the specific voltage pulse is produced by removing at least one sub-pulse, preferably the earlier occurring one, from the normal voltage pulse.

In still another preferred embodiment, each normal electric pulse is a single current pulse, and the specific electric pulse is produced by delaying the normal current pulse by a predetermined time so that a part of the specific electric pulse overlaps a part of the normal current pulse.

In a further preferred embodiment, the normal and specific electric pulses are produced according to both a data to be printed and a data which has been printed previously.

The above and other objects and features of the invention will be apparent from the following description taken in connection with the accompanying drawings in which:

BRIEF DESCRIPTION OF THE DRAWINGS

FIG. 17(*a*) shows a waveform chart according to a conventional electrode driving method and FIG. 17(*b*) shows an image printed by the pulses shown in FIG. 17(*a*)

DESCRIPTION OF THE PREFERRED EMBODIMENTS

Figure 1:
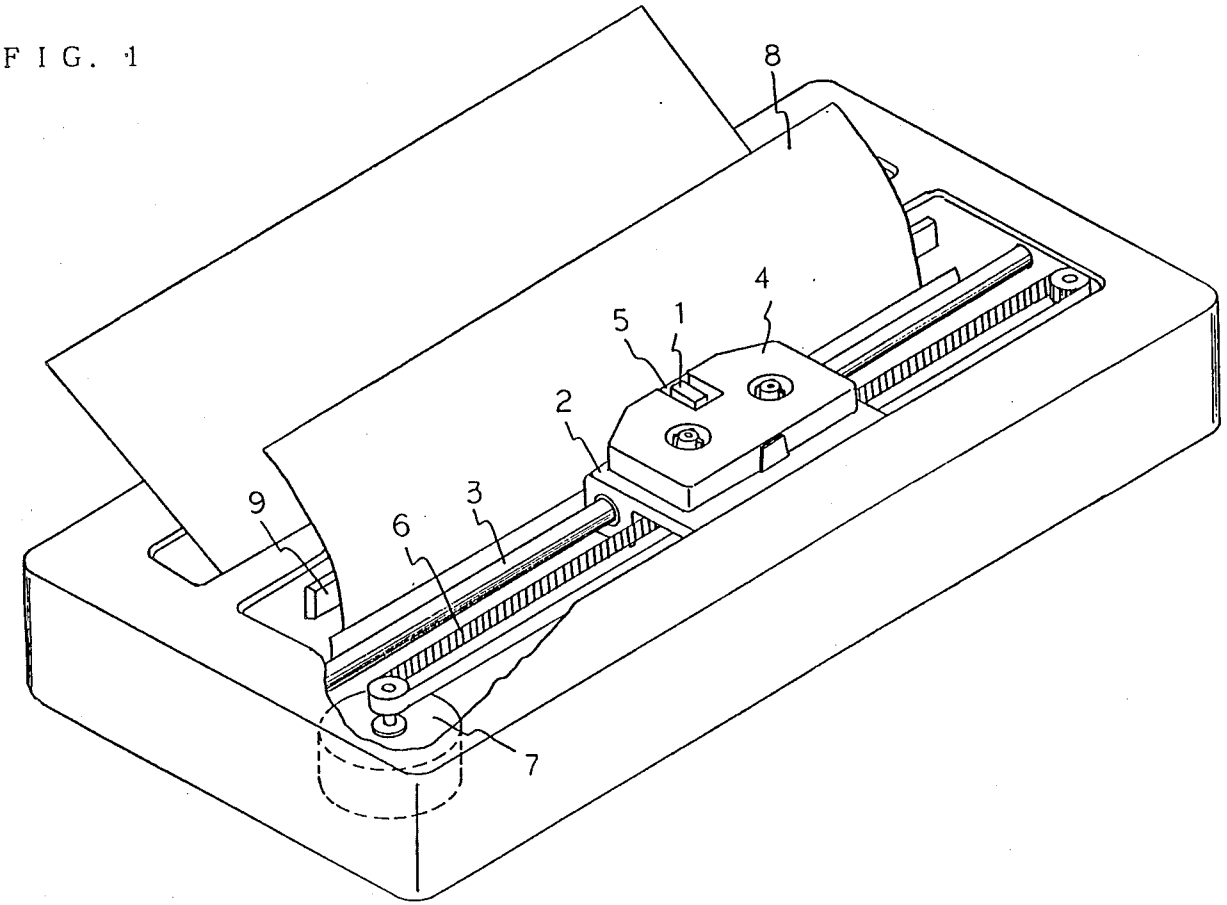
FIG. 1 is a schematic perspective view showing an exemplary outline of a resistive ribbon thermal transfer printing apparatus according to the invention.

FIG. 1 shows an outline of an embodiment of resistive ribbon thermal transfer printing apparatus (RRTT printer, hereafter) according to the present invention. A printing head 1 and a ribbon cartridge 4 in which a resistive ribbon 5 is stored are mounted on a carriage 2 which is driven by a motor 7 via a belt 6 to move reciprocally along a guide bar 3. A sheet of paper 8 is fed between a platen 9 and the resistive ribbon 5. During printing, the printing head 1 is pressed onto the resistive ribbon 5 so that the printing head 1 is kept in contact with the resistive ribbon 5 and the resistive ribbon 5 is kept in contact with the paper 8. The resistive ribbon 5 is moved in one direction in synchronization with the printing operation by a known mechanism such as the one used in conventional typewriters.

Figure 2:
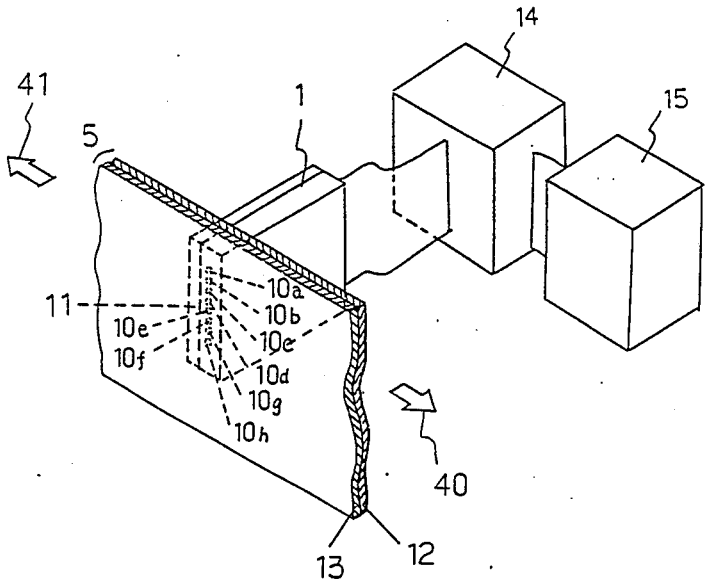
FIG. 2 is a schematic perspective view showing essential portions of the apparatus shown in FIG. 1.
Figure 3:
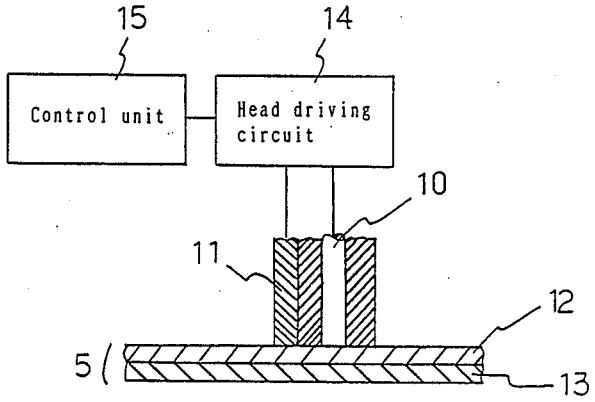
FIG. 3 is a schematic side sectional view showing a printing head and a resistive ribbon.

FIGS. 2 and 3 show principal portions of the RRTT printer shown in FIG. 1. The printing head 1 has a common electrode 11 and a plurality of recording electrodes 10 each being spaced from the common electrode 11 at a fixed distance. In the illustrated example, eight recording electrodes 10*a* through 10*h* are arranged in a straight line parallel to the common electrode 11. The resistive ribbon 5 has two layers—a resistive material layer 12 made of a resin such as a polycarbonate containing carbon, and an ink layer 13 made of a thermally meltable ink. The common and recording electrodes are in contact with the resistive material layer side surface of the resistive ribbon 5. The ink layer side surface of the resistive ribbon 5 is in contact with the paper 8 shown in FIG. 1 but not shown in FIGS. 2 and 3.

In the embodiment shown in FIG. 1, the resistive ribbon 5 moves either in a direction shown by an arrow 40 in FIG. 2 so that the relative position of the printing head to the resistive ribbon moves in a direction from the recording electrode side to the common electrode side or in a direction shown by an arrow 41 in FIG. 2 so that the relative position of the printing head to the resistive ribbon moves in a direction from the common electrode side to the recording electrode side. The direction of the relative movement of the printing head to the resistive ribbon is in a direction perpendicular to the line along which the recording electrodes are arranged. Alternatively, the resistive ribbon may be fixed and the printing head may be moved in either the direction 41 or the direction 40.

Between the respective recording electrodes 10*a*10*h* and the common electrode 11 of the printing head 1 are selectively supplied with voltage pulses for energizing the recording electrodes from a head driving circuit 14 under control of a control unit 15.

Figure 4:
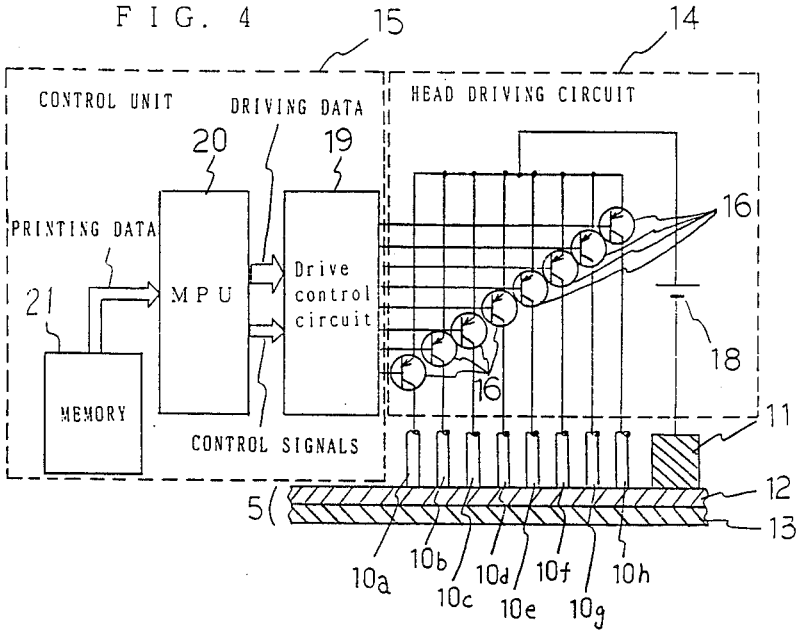
FIG. 4 is a block diagram showing a circuitry of the printing apparatus with a head driving circuit for generating voltage pulses.

An exemplary configuration of the head driving circuit 14 and the control unit 15 is shown in FIG. 4. The head driving circuit 14 comprises a plurality of switching transistors 16 which are connected at their respective collector terminals to the recording electrodes 10*a*–10*h*, respectively, and at their respective emitter terminals in common to a power source 18 which is connected at its ground terminal to the common electrode 11. Each of the switching transistors turns on in response to a negative logic voltage pulse applied from the control unit 15 to its base terminal to energize the corresponding recording electrode connected to its collector terminal.

The control unit 15 comprises a memory 21 having stored therein data to be printed, a microprocessing unit (MPU) 20 which reads the printing data from the memory 21 and produces driving data and control signals, and a drive control circuit 19 which is controlled by the control signals for producing negative logic driving pulses for driving the switching transistors 16 from the driving data.

Figure 5:
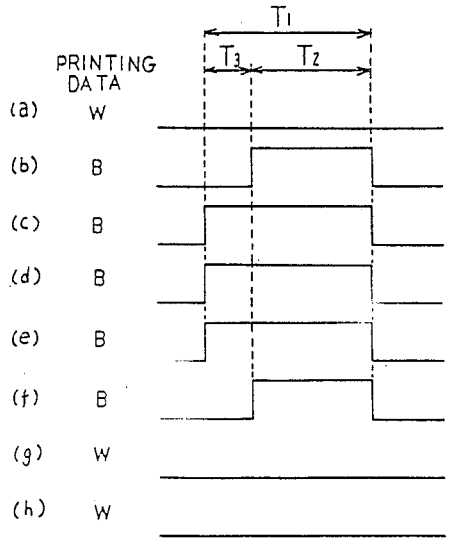
FIG. 5 is a waveform chart showing an electrode driving method according to the present invention.

FIG. 5 shows an example of driving data produced by the MPU 20 in the case that the relative position of the printing head to the resistive ribbon moves in the direction from the recording electrode side to the common electrode side. The positive logic pulses shown in FIG. 5 are inverted in polarity to become the negative logic driving pulses by the drive control circuit 19. The driving data (a) through (h) are for energizing the recording electrodes 10*a* through 10*h*, respectively. The printing data "W" denotes "white" (corresponding to logic "0") where no dot is printed, and the printing data "B" denotes "black" (corresponding to logic "1") where a dot is printed. Pulses each having a pulse width T1 are generated at the same timing and are called "normal pulses". Pulses each having a pulse width T2 are generated at the timing delayed by T3 from the leading edge of the normal pulse and are called "specific pulses". The normal and specific pulses are terminated at the same timing, i.e., $T1=T3+T2$.

The normal pulse is used for energizing a recording electrode disposed between two recording electrodes which are to be also energized. The specific pulse is used for energizing a recording electrode which is not disposed between two recording electrodes which are to be also energized. This way of selection of pulses may be easily understood from FIG. 5.

Figure 6:
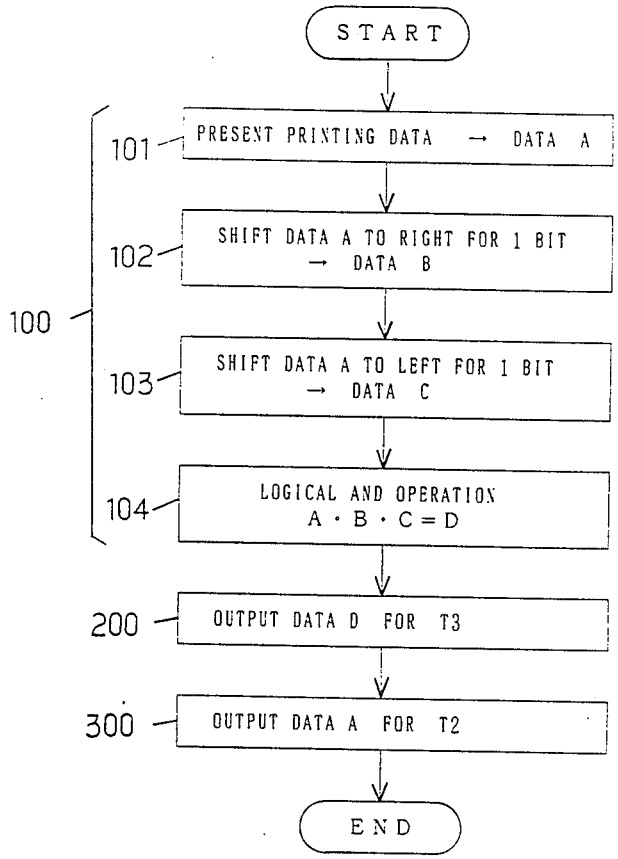
FIG. 6 is a flow chart for producing the pulses shown in FIG. 5.

The MPU 20 produces the driving data shown in FIG. 5 according to a program shown by a flow chart in FIG. 6. In step 101, a present printing data is read from the memory 21 as a data A, which is "01111100" in the case of FIG. 5. In step 102, data A is shifted to right for 1 bit, the result being a data B, "00111110". In step 103, data A is shifted to left for 1 bit, the result being a data C, "11111000". In step 104, a logical AND operation of A·B·C is executed to obtain a data D, "00111000". Thus, the step comprising steps 101 through 104 is a data D calculating step 100. In step 200, the MPU 20 outputs data D for the period T3 to the drive control circuit 19. In step 300, the MPU 20 outputs data A for the period T2 to the drive control circuit 19. As a result, the pulses shown in FIG. 5 are produced and inverted in polarity in the drive control circuit 19 to be the negative logic pulses, which are respectively applied to the respective base terminals of the switching transistors 16. In response to the negative logic pulse having the same logic as the pulse shown in FIG. 5, the switching transistors 16 apply voltage pulses corresponding to the pulses shown in FIG. 5 to the recording electrodes.

Each of the voltage pulses applied to the recording electrodes 10(*b*) and 10(*f*), which correspond to the specific pulses in FIG. 5, has a smaller energy than that of each of the voltage pulses applied to the recording electrodes 10(*c*) through 10(*e*), which correspond to the normal pulses in FIG. 5. The current caused to flow through the resistive material layer of the resistive ribbon by each of the recording electrodes 10(*c*) through 10(*e*) energized by the normal voltage pulses is interacted by the currents caused to flow by the adjacent two energized recording electrodes to be reduced in the flowing area. The current caused to flow by each of the recording electrodes 10(*b*) and 10(*f*) energized by the specific voltage pulses is interacted only by the current caused to flow by one adjacent energized recording electrode, so that its flowing area is less reduced. But, since the energy given by the specific voltage pulse is smaller in amount than and different in timing from that given by the normal voltage pulse, the current flowing area under the recording electrode energized by the specific voltage pulse becomes almost equal to the reduced current flowing area under the recording electrode energized by the normal voltage pulse. In other words, the specific voltage pulses and the normal voltage pulses are selectively applied to the recording electrodes so that the currents caused to flow by the respective energized electrodes become uniform, which allows the printed dots to be equal in size. Accordingly, a high quality image can be printed.

Further, since all of the recording electrodes to be energized are energized at substantially the same time, the printing speed is higher than the time-divisional driving system. Moreover, since the pulse width of the energizing pulse can be made relatively larger than the time-divisional driving system, the resistive ribbon will not be damaged by the current pulse flown therethrough.

The normal electric pulses and specific electric pulses for selectively energizing the recording electrodes to obtain the above-described effects can be produced in other ways as will be described below.

Figure 7:
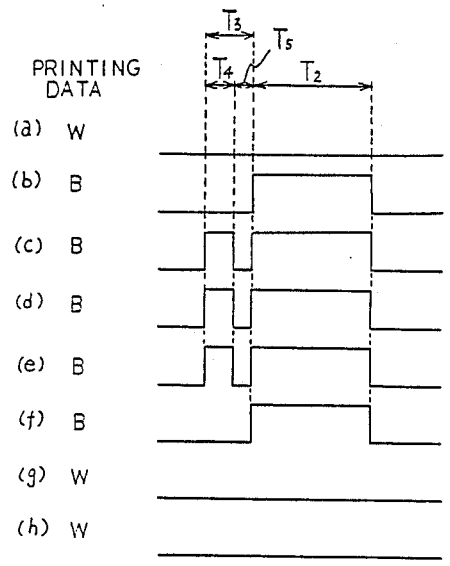
FIG. 7 is a waveform chart showing another electrode driving method according to the present invention.

FIG. 7 shows another example of driving data in the case that the position of the printing head relative to the resistive ribbon moves in the direction from the recording electrode side to the common electrode side. In FIG. 7, the normal pulse is divided into two sub-pulses—the first one having a pulse width T4, and the second one delayed by T5 from the trailing edge of the first sub-pulse and having a pulse width T2. The specific pulse is identical with the second sub-pulse of the normal pulse and occurring at the same timing as the second sub-pulse.

Figure 8:
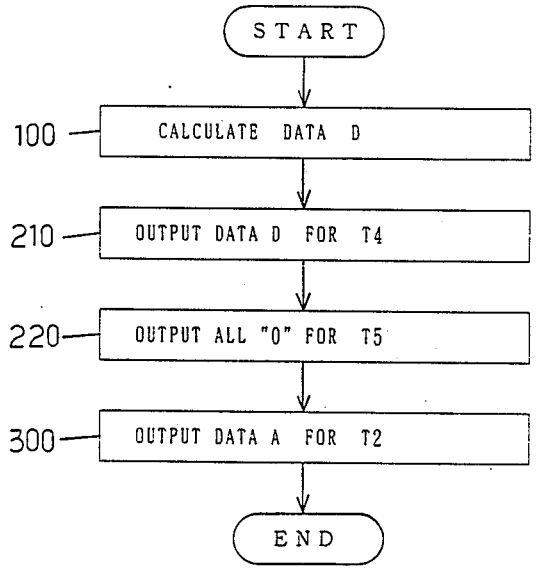
FIG. 8 is a flow chart for producing the pulses shown in FIG. 7.

FIG. 8 shows a flow chart of a program executed in the MPU 20 for producing the pulse shown in FIG. 7. In step 100, the same data D as that described with reference to FIG. 6 is produced. In step 210, the MPU 20 outputs data D for the period T4. In step 220, the MPU 20 outputs a data of all bits "0" for the period T5. In step 300, the MPU 20 outputs the present printing data A for the period T2.

Figure 9:
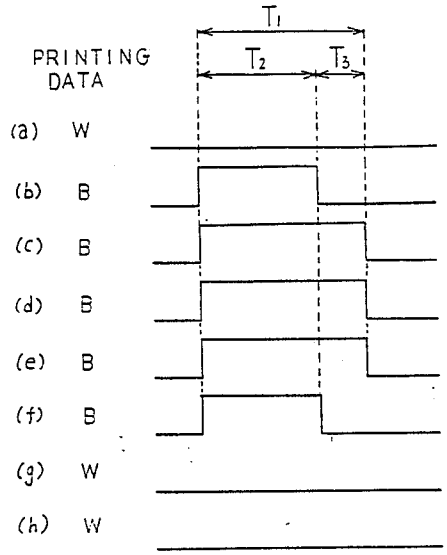
FIG. 9 is a waveform chart showing still another electrode driving method according to the present invention.
Figure 10:
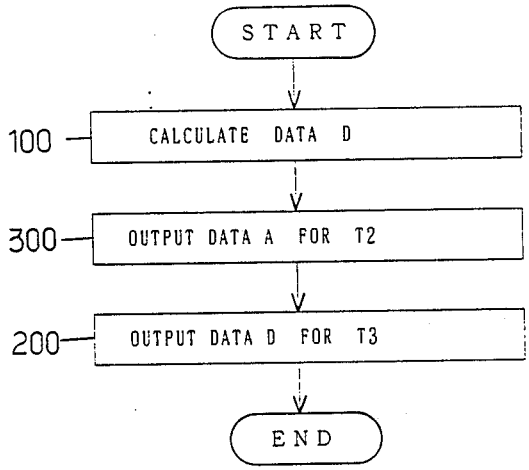
FIG. 10 is a flow chart for producing the pulses shown in FIG. 9.

FIG. 9 shows an example of driving data in the case that the position of the printing head relative to the resistive ribbon moves in the direction from the common electrode side to the recording electrode side, i.e., the direction opposite to that in the case of FIGS. 5 and 7. In FIG. 9, the specific pulse is generated at the same timing as that of the normal pulse, but terminated at the timing prior by T3 to the trailing edge of the normal pulse. The pulses shown in FIG. 9 can be produced by exchanging the order of the steps 200 and 300 shown in the flow chart of FIG. 6 as shown in FIG. 10.

Figure 11:
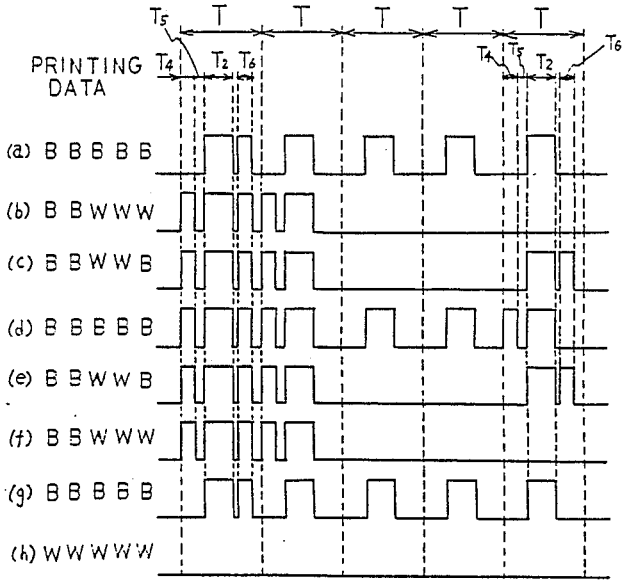
FIG. 11 is a waveform chart showing a further electrode driving method according to the present invention.

When the printing speed is increased, the temperature rise of the printing head due to the heat transferred from the heated resistive ribbon is also increased. The excessive temperature rise of the printing head would cause a bad effect on printing quality. In this case, when turning the point of view, it can be understood that the area of the resistive ribbon to be heated for printing has been heated to a certain extent by the heat generated during the previous printing operation. This means that the recording electrodes to be energized next may be energized by less energy than that normally required. In view of the above, the pulses for energizing the recording electrodes may be produced according not only to the present printing data but also to the previous printing data. FIG. 11 shows an example of driving data for satisfying such condition in the case that the relative position of the printing head to the resistive ribbon moves in the direction from the recording electrode side to the common electrode side.

In FIG. 11, each period T in which one printing operation for printing one printing data is performed is divided into four periods—a first period T4 for a first sub-pulse, a second period T5 in which no sub-pulse will occur, a third period T2 for a second sub-pulse, and a fourth period T6 for a third sub-pulse. In the figure, although there are illustrated spaces between T2 and T6 and between T6 and the end of T, they are for the purpose of clearly showing the third sub-pulse distinguished from the second sub-pulse and the first sub-pulse in the next period T, and do not exist actually. The normal pulse for normal energization is composed of the first through third sub-pulses, and the specific pulse for normal energization is composed of the second and third sub-pulses. The first and second sub-pulses are produced according to the same rule between the normal pulse and the specific pulse as described before. That is, both of the first and second sub-pulses are produced for energizing a recording electrode which is to be energized and disposed between two adjacent recording electrodes which are to be energized, and only the second sub-pulse is produced for energizing a recording electrode which is to be energized and is not disposed between two adjacent recording electrodes which are to be energized.

The third sub-pulse is produced only when a recording electrode which is to be energized by the present printing data was not energized by the previous printing data. The data for producing the third sub-pulse can be obtained from the present printing data and the previous printing data by a calculation described below.

Figure 12:
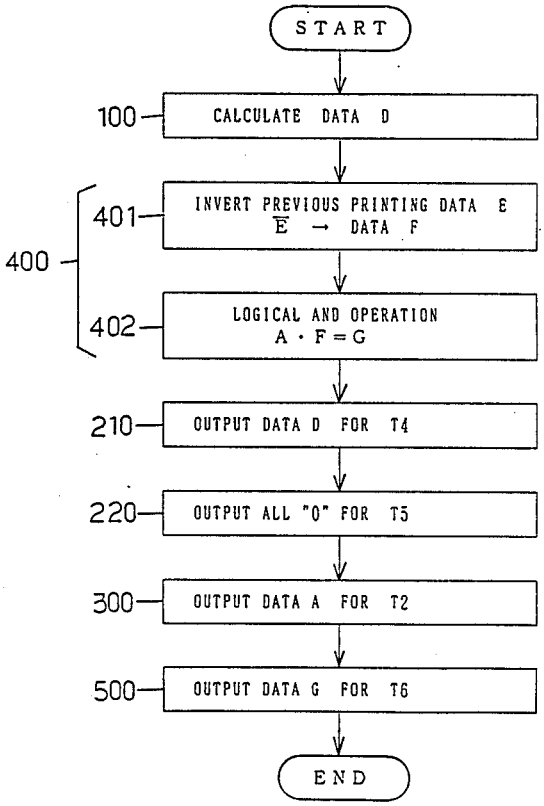
FIG. 12 is a flow chart for producing the pulses shown in FIG. 11.

FIG. 12 shows a flow chart of a program executed in the MPU 20 for producing the pulses shown in FIG. 11. Here, suppose that the present printing data denoted by data A is the fifth one of the five printing data shown in FIG. 11. The previous printing data, the forth one in FIG. 11, is denoted by data E. Data A is "10111010" ("BWBBBWBW"), and data E is "10010010" ("BWWBWWBW").

In FIG. 12, the same data D as that shown in FIG. 6 is produced in step 100, here D="00010000". In step 401, the previous printing data E is inverted to be a data F ($=\overline{E}$)="01101101". In step 402, a logical AND operation of A·F is executed to obtain a data G (=A·F)="00101000". This data G calculated in a step 400 composed of steps 401 and 402 is the data for producing the third sub-pulses in FIG. 11. The MPU 20 outputs data D for the period T4 in step 210, an all "0" data for T5 in step 220, and data A for T2 in step 300, in the same way as that shown in FIG. 8. Thereafter, in step 500, the MPU 20 outputs data G for the period T6. In this way, the pulses as shown in the last printing period T in FIG. 11 can be produced.

The driving method described with reference to FIGS. 11 and 12 is effective to prevent the printing head from being excessively heated during a high speed printing operation.

Figure 13:
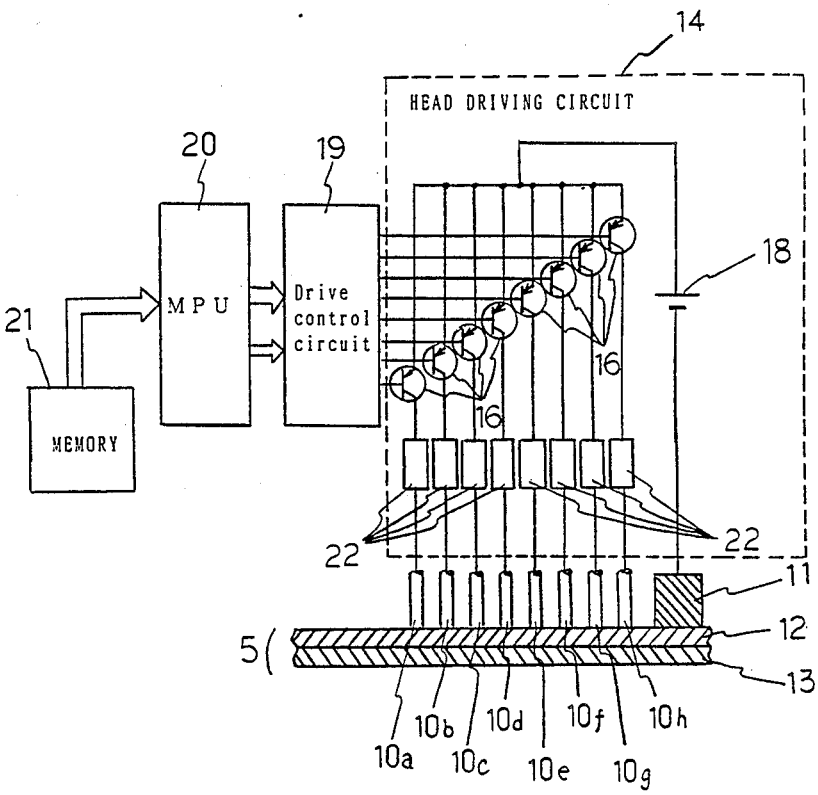
FIG. 13 is a block diagram showing a circuitry of the printing apparatus with a head driving circuit for generating current pulses.

In the foregoing description, the recording electrodes are energized by voltage pulses applied thereto. Alternatively, the recording electrodes may be energized by current pulses supplied thereto. FIG. 13 shows an embodiment for energizing the recording electrodes by current pulses. The embodiment shown in FIG. 13 differs from the embodiment shown in FIG. 4 only in the configuration of the head driving circuit 14 in which constant current generating circuits 22 are connected between the respective collector terminals of the switching transistors 16 and the recording electrodes 10*a* through 10*h*, respectively. Each of the constant current generating circuits 22 generates a constant current pulse corresponding to a voltage pulse applied thereto for energizing a recording electrode connected thereto.

Figure 14:
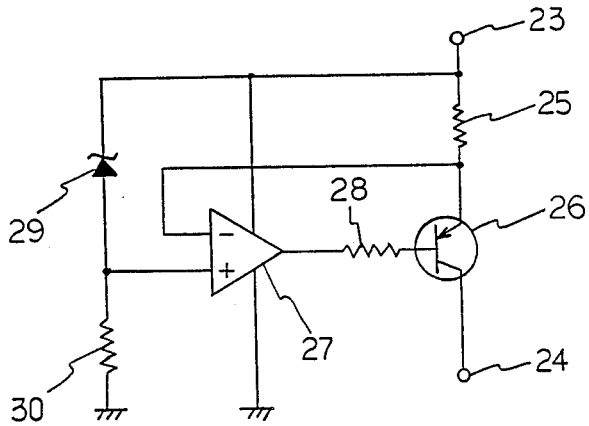
FIG. 14 is a circuit diagram showing an arrangement of a constant current generating circuit used in the head driving circuit shown in FIG. 13.

FIG. 14 shows an exemplary circuit arrangement of each of the constant current generating circuits 22. An input terminal 23 is connected to the collector terminal of corresponding one of the switching transistor 16. An output terminal 24 is connected to corresponding one of the recording electrodes 10*a*–10*h*. A resistor 25 is connected at one terminal to the input terminal 23 and at the other terminal to the emitter terminal of a transistor 26 and the inverting input terminal of an operational amplifier 27. The non-inverting input terminal of the operational amplifier 27 is connected to a connection point of a zener diode 29 and a resistor 30 which are connected in series between the input terminal 23 and the ground to keep constant the voltage at the connection point thereof. The output terminal of the operational amplifier 27 is connected via a resistor 28 to the base terminal of the transistor 26. The collector terminal of the transistor 26 is connected to the output terminal 24. The operational amplifier 27 operates to keep constant a voltage across the resistor 25 so that a constant current flows through the resistor 25 and the transistor 26 to the output terminal 24 when a voltage pulse is applied to the input terminal 23.

Figure 15:
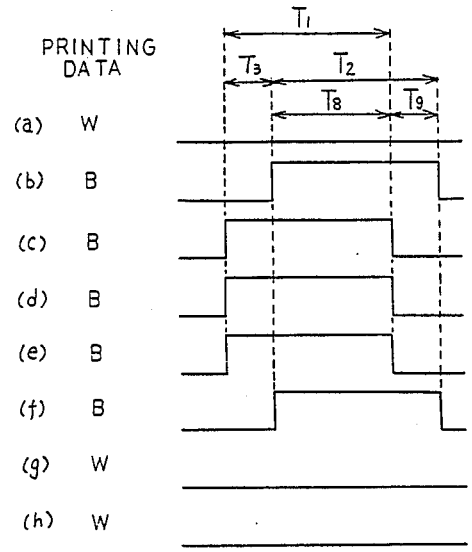
FIG. 15 is a waveform chart showing an electrode driving method using the circuitry shown in FIG. 13.

FIG. 15 shows an example of driving data for energizing the recording electrodes with the arrangement shown in FIG. 13. The normal pulses occur during the period T1. The specific pulses occur during the period T2 delayed by T3 from the leading edge of the normal pulse so that the specific pulses overlap the normal pulses during the period T8. The length of T1 is equal to the length of T2. Thus, the timing difference T9 between the trailing edges of the normal and specific pulses is equal to the length of T3. In other words, the specific pulse may be regarded as such a pulse that is obtained by delaying the normal pulse by T3. The example shown in FIG. 15 is effective in the case that the relative position of the printing head to the resistive ribbon moves in the direction from the recording electrode side to the common electrode side.

Figure 16:
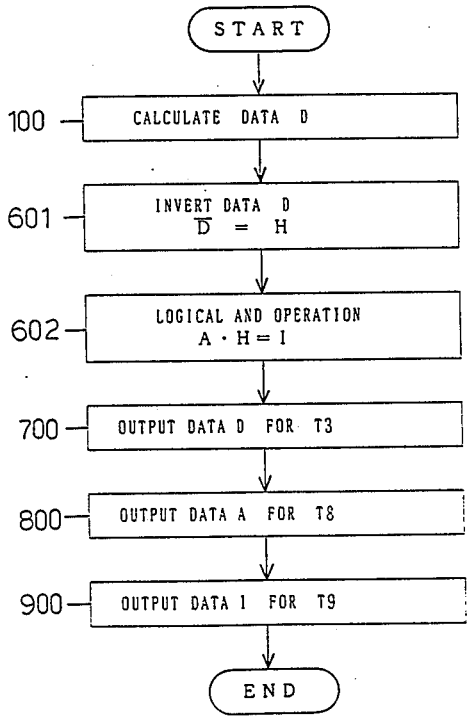
FIG. 16 is a flow chart for producing the pulses shown in FIG. 15.
Figure 18:
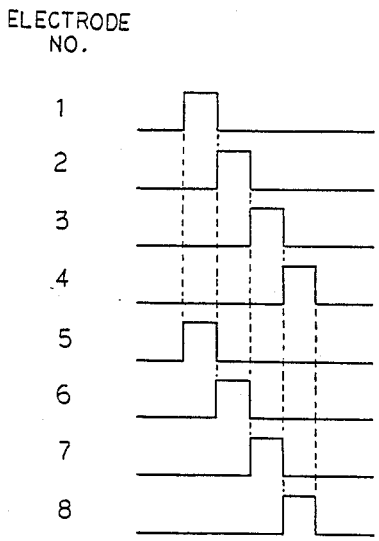
FIG. 18 PRIOR ART
FIG. 18 shows a waveform chart of a conventional time-divisional electrode driving method.

FIG. 16 shows a flow chart of a program executed in the MPU 20 for producing the driving pulses shown in FIG. 15. In step 100, the same data D as that shown in FIG. 6 is produced, i.e., data A="01111100" and data D="00111000". In step 601, data D is inverted to be a data H="11000111". In step 602, a logical AND operation of A·H is executed to obtain a data I=A·H="01000100". The MPU 20 outputs data D for the period T3 in step 700, data A for T8 in step 800, and data I for T9 in step 900.

What is claimed is:

1. A resistive ribbon thermal transfer printing apparatus using a resistive ribbon which comprises a resistive material layer and a thermally meltable ink layer which is in contact with a surface of a receiving member on which an image is to be printed, said apparatus comprising:

a printing head having a plurality of recording electrodes arranged in a line and a common electrode disposed in a spaced relationship to the recording electrodes, the recording and common electrodes being in contact with the resistive material layer of the resistive ribbon;

a driving means for moving at least one of the resistive ribbon and the printing head relatively to each other;

an energizing means for selectively applying electric pulses to the plurality of recording electrodes at substantially the same time to selectively energize the plurality of recording electrodes; and a control means for controlling the energizing means according to at least a data to be printed so that the energizing means applies a normal electric pulse having a predetermined energy to a recording electrode which is to be energized and disposed between two recording electrodes which are to be energized, and a specific electric pulse having a smaller energy than the predetermined energy of the normal electric pulse to a recording electrode which is to be energized but not disposed between two recording electrodes which are to be energized.

2. A resistive ribbon thermal transfer printing apparatus using a resistive ribbon which comprises a resistive material layer and a thermally meltable ink layer which is in contact with a surface of a receiving member on which an image is to be printed, said apparatus comprising:

a printing head having a plurality of recording electrodes arranged in a line and a common electrode disposed in a spaced relationship to the recording electrodes, the recording and common electrodes being in contact with the resistive material layer of the resistive ribbon;

a driving means for moving at least one of the resistive ribbon and the printing head relatively to each other;

an energizing means for selectively applying voltage pulses to the plurality of recording electrodes at substantially the same time to selectively energize the plurality of recording electrodes; and a control means for controlling the energizing means according to a printing data to be printed so that the energizing means applies a normal voltage pulse having a predetermined pulse width to a recording electrode which is to be energized and disposed between two recording electrodes which are to be energized, and a specific voltage pulse having a smaller pulse width than the predetermined pulse width of the normal voltage pulse to a recording electrode which is to be energized but not disposed between two recording electrodes which are to be energized.

3. The apparatus according to claim 2, wherein the driving means moves at least one of the resistive ribbon and the printing head so that a position of the printing head relative to the resistive ribbon moves in a direction from the recording electrode side to the common electrode side of the printing head, and wherein the specific voltage pulse is generated at a timing delayed by a predetermined time from a leading edge of the normal voltage pulse.

4. The apparatus according to claim 2, wherein the driving means moves at least one of the resistive ribbon and the printing head so that a position of the printing head relative to the resistive ribbon moves in a direction from the common electrode side to the recording electrode side of the printing head, and wherein the specific voltage pulse is terminated at a timing prior by a predetermined time to a trailing edge of the normal voltage pulse.

5. The apparatus according to claim 2, wherein the normal voltage pulse is composed of at least two sequentially occurring sub-pulses, and the specific voltage pulse is produced by removing at least one of the at least two sub-pulses from the normal voltage pulse.

6. A resistive ribbon thermal transfer printing apparatus using a resistive ribbon which comprises a resistive material layer and a thermally meltable ink layer which is in contact with a surface of a receiving member on which an image is to be printed, said apparatus comprising:

a printing head having a plurality of recording electrodes arranged in a line and a common electrode disposed in a spaced relationship to the recording electrodes, the recording and common electrodes being in contact with the resistive material layer of the resistive ribbon;

a driving means for moving at least one of the resistive ribbon and the printing head so that a position of the printing head relative to the resistive ribbon moves in a direction from the recording electrode side to the common electrode side of the printing head;

an energizing means for selectively applying voltage pulses to the plurality of recording electrodes at substantially the same time to selectively energize the plurality of recording electrodes; and a control means for controlling the energizing means according to a printing data to be printed so that the energizing means applies sequentially occurring first and second voltage pulses to a recording electrode which is to be energized and disposed between two recording electrodes which are to be energized, and applies only the second voltage pulse of the sequentially occurring first and second voltage pulses to a recording electrode which is to be energized but not disposed between two recording electrodes which are to be energized.

7. A resistive ribbon thermal transfer printing apparatus using a resistive ribbon which comprises a resistive material layer and a thermally meltable ink layer which is in contact with a surface of a receiving member on which an image is to be printed, said apparatus comprising:

a printing head having a plurality of recording electrodes arranged in a line and a common electrode disposed in a spaced relationship to the recording electrodes, the recording and common electrodes being in contact with the resistive material layer of the resistive ribbon;

a driving means for moving at least one of the resistive ribbon and the printing head relatively to each other;

an energizing means for selectively supplying current pulses to the plurality of recording electrodes at substantially the same time to selectively energize the plurality of recording electrodes; and a control means for controlling the energizing means according to a printing data to be printed so that the energizing means supplies a normal current pulse having a predetermined pulse width to a recording electrode which is to be energized and disposed between two recording electrodes which are to be energized, and a specific current pulse having the predetermined pulse width and occurring at a different timing from the normal current pulse so as to partly overlap the normal current pulse to a recording electrode which is to be energized but not disposed between two recording electrodes which are to be energized.

8. The apparatus according to claim 7, wherein the driving means moves at least one of the resistive ribbon and the printing head so that a position of the printing head relative to the resistive ribbon moves in a direction from the recording electrode side to the common electrode side of the printing head, and wherein the specific current pulse is generated at a timing delayed by a predetermined time from a leading edge of the normal current pulse.

9. A resistive ribbon thermal transfer printing apparatus using a resistive ribbon which comprises a resistive material layer and a thermally meltable ink layer which is in contact with a surface of a receiving member on which an image is to be printed, said apparatus comprising:

a printing head having a plurality of recording electrodes arranged in a line and a common electrode disposed in a spaced relationship to the recording electrodes, the recording and common electrodes being in contact with the resistive material layer of the resistive ribbon;

a driving means for moving at least one of the resistive ribbon and the printing head relatively to each other;

an energizing means for selectively supplying current pulses to the plurality of recording electrodes at substantially the same time to selectively energize the plurality of recording electrodes; and a control means for controlling the energizing means according to a present printing data to be printed and a previous printing data which has been printed previously, the control means causing the energizing means to apply: a first normal electric pulse having a predetermined energy to a recording electrode which is to be energized by the present printing data and has not been energized by the previous printing data and is disposed between two recording electrodes which are to be energized by the present printing data; a first specific electric pulse having a smaller energy than the energy of the first normal electric pulse to a recording electrode which is to be energized by the present printing data and has not been energized by the previous printing data and is not disposed between two recording electrodes which are to be energized by the present printing data; a second normal electric pulse having a smaller energy than the energy of the first normal electric pulse to a recording electrode which is to be energized by the present printing data and has been energized by the previous printing data and is disposed between two recording electrodes which are to be energized by the present printing data; and a second specific electric pulse having a smaller energy than the energy of the first specific electric pulse to a recording electrode which is to be energized by the present printing data and has been energized by the previous printing data and is not disposed between two recording electrodes which are to be energized by the present printing data.

10. The apparatus according to claim 9, wherein the driving means moves at least one of the resistive ribbon and the printing head so that a position of the printing head relative to the resistive ribbon moves in a direction from the recording electrode side to the common electrode side of the printing head, and wherein the energizing means generates first through third voltage pulses which occur sequentially, the first normal electric pulse being composed of the first through third voltage pulses, the second normal electric pulse being composed of the first and second voltage pulses, the first specific electric pulse being composed of the second and third voltage pulses, and the second specific electric pulse being composed of the second voltage pulse.

* * * * *